US011521808B2

(12) United States Patent
Degli Innocenti et al.

(10) Patent No.: US 11,521,808 B2
(45) Date of Patent: Dec. 6, 2022

(54) SWITCHING APPARATUS OF THE HYBRID TYPE INCLUDING SOLID-STATE SWITCHES IN SERIES WITH ELECTRO-MECHANICAL SWITCHES

(71) Applicant: ABB S.p.A., Milan (IT)

(72) Inventors: Luigi-Arturo Degli Innocenti, Bergamo (IT); Alessio Bergamini, Gazzaniga (IT); Luca Omati, Cavenago di Brianza (IT)

(73) Assignee: ABB S.p.A., Milan (IT)

( * ) Notice: Subject to any disclaimer, the term of this patent is extended or adjusted under 35 U.S.C. 154(b) by 0 days.

(21) Appl. No.: 17/375,480

(22) Filed: Jul. 14, 2021

(65) Prior Publication Data

US 2022/0037098 A1 Feb. 3, 2022

(30) Foreign Application Priority Data

Jul. 28, 2020 (EP) ..... 20188240

(51) Int. Cl.
*H01H 9/54* (2006.01)

(52) U.S. Cl.
CPC ..... *H01H 9/548* (2013.01)

(58) Field of Classification Search
CPC ..... H01H 2009/544; H01H 2071/006; H01H 2071/124; H01H 33/46; H01H 71/123; H01H 89/00; H01H 9/54; H01H 9/542; H01H 9/548; H02B 11/12
See application file for complete search history.

(56) References Cited

U.S. PATENT DOCUMENTS

| | | | | |
|---|---|---|---|---|
| 2017/0004948 | A1 | 1/2017 | Leyh | |
| 2017/0294275 | A1* | 10/2017 | Spence | H02H 3/006 |
| 2019/0341213 | A1* | 11/2019 | Kouroussis | H02H 3/167 |
| 2020/0013570 | A1* | 1/2020 | Davidson | H01H 9/54 |
| 2022/0037097 | A1* | 2/2022 | Raciti | H01H 71/123 |
| 2022/0037917 | A1* | 2/2022 | Degli Innocenti | H01H 9/08 |
| 2022/0037919 | A1* | 2/2022 | Degli Innocenti | H01H 9/548 |

FOREIGN PATENT DOCUMENTS

| | | | |
|---|---|---|---|
| DE | 2532593 | A1 | 1/1977 |
| EP | 3336872 | A1 | 6/2018 |

OTHER PUBLICATIONS

European Patent Office, Extended Search Report issued in corresponding Application No. 20188240.4, dated Dec. 7, 2020, 7 pp.

* cited by examiner

*Primary Examiner* — Jared Fureman
*Assistant Examiner* — Nicolas Bellido
(74) *Attorney, Agent, or Firm* — Armstrong Teasdale LLP

(57) ABSTRACT

A switching apparatus for electric power distribution grids including a first switching unit having one or more first electric poles, each first electric pole being electrically connectable with a corresponding first line conductor of an electric line and including one or more solid-state switches adapted to operate in a conduction state or in an interdiction state to allow or interrupt a current flow, and a second switching unit having one or more second electric poles, each second electric pole being electrically connectable with a corresponding second line conductor of said electric line and electrically connected in series with a corresponding first electric pole of said first switching unit. The switching apparatus further includes a controller implementing a robust control logic to the operation of said first and second switching units.

13 Claims, 9 Drawing Sheets

OPEN STATE
TO STAND-BY STATE
TRANSITION

STAND-BY STATE TO OPEN STATE TRANSITION

SWITCHING APPARATUS OF THE HYBRID TYPE INCLUDING SOLID-STATE SWITCHES IN SERIES WITH ELECTRO-MECHANICAL SWITCHES

BACKGROUND

The present invention relates to a switching apparatus for electric power distribution grids, such as a circuit breaker or another apparatus of similar type.

As it is known, low voltage switching apparatuses are used in electric circuit or grids to allow a correct operation of specific circuit or grid sections. For instance, these apparatuses may be used to ensure the availability of a nominal current to feed several utilities, enable the proper insertion and disconnection of electric loads and protect (especially circuit breakers) the electric grid and installed electric loads against fault events, such as overloads and short circuits.

Most traditional switching apparatuses include an electro-mechanical switching unit having one or more electric poles, each comprising a pair of electric contacts adapted to be coupled or uncoupled to allow or interrupt a current flow.

Although they have proven to be very robust and reliable, these apparatuses show a relatively long interruption time in direct current ("DC") applications, mainly at relatively high voltages (between 1-1.5 kV DC). As a consequence, electric arcs, which usually strike between the electric contacts under separation, may last for a relatively long time. This often causes severe wear phenomena of the electric contacts and a consequent remarkable reduction of the operating reliability and electrical endurance.

In order to overcome these technical issues, they have been designed switching apparatuses (also referred to as "SSCBs"—Solid-State Circuit Breakers), which include a switching unit having, for each electric pole, one or more solid-state switches. Solid-state switches are semiconductor-based switches adapted to operate in a conduction state or in an interdiction state to allow or interrupt a current flow.

The main advantage of SSCBs consists in that they have a potentially unlimited electrical endurance due to the circumstance that breaking operations are carried out without the formation of electric arcs. Further, their interruption time is remarkably shorter in comparison with the interruption time of switching apparatuses of the electro-mechanical type.

An important drawback of SSCBs consists in that they cannot generally provide a galvanic insulation between the line conductors connected thereto. In fact, when a voltage is applied to the power terminals of a solid-state switch (e.g. the collector and emitter terminals of an IGBT), leakage currents typically flow even if said switch is in an interdiction state.

Recently, switching apparatuses including a SSCB switching unit and an electro-mechanical switching unit, which are electrically connected in series, have been developed.

These switching apparatuses (generally referred to as "hybrid switching apparatuses") allow exploiting all the advantages provided by SSCBs in terms of reliability and interruption time reduction and, at the same time, they allow obtaining a galvanic insulation between the line conductors connected thereto.

However, these switching apparatuses typically require a tight time synchronization between switching operations of the SSCB switching unit and the electro-mechanical switching unit in order to properly operate. Therefore, they generally need complex and expensive control resources to ensure satisfactory levels of efficiency and reliability.

SUMMARY

The main aim of the present invention is providing a switching apparatus of the hybrid type, particularly of the type including a SSCB switching unit and an electro-mechanical switching unit electrically connected in series, which makes it possible to overcome or mitigate the aforementioned problems of the state of the art.

Within this aim, an object of the present invention is providing a switching apparatus of the hybrid type, which can be easily controlled in operation without arranging complex and expensive control resources.

Another object of the present invention is providing a switching apparatus of the hybrid type, which ensures high levels of efficiency and reliability in operation.

Another object of the present invention is providing a switching apparatus of the hybrid type, which is relatively easy and cheap to manufacture at industrial level.

This aim and these objects, together with other objects that will become evident from the following description and accompanying drawings, are achieved, according to the present invention, by a switching apparatus, according to claim 1 and the related dependent claims set out below.

The switching apparatus, according to the invention, comprises a first switching unit having one or more first electric poles. Each first electric pole is electrically connectable with a corresponding first line conductor of an electric line and it comprises one or more solid-state switches adapted to operate in a conduction state or in an interdiction state to allow or interrupt a current flow. Said first switching unit is adapted to switch reversibly between a closed condition, in which said solid-state switches are in a conduction state, and an open condition, in which said solid-state switches are in an interdiction state.

The switching apparatus, according to the invention, comprises a second switching unit having one or more second electric poles. Each second electric pole is electrically connectable with a corresponding second line conductor of said electric line and it is electrically connected in series with a corresponding first electric pole of said first switching unit.

Each second electric pole comprises electric contacts adapted to operate in a coupled state or on an uncoupled state to allow or interrupt a current flow along said second electric pole. Said second switching unit is adapted to switch reversibly between a closed condition, in which said electric contacts are in a coupled state, and an open condition, in which said electric contacts are in an uncoupled state.

The switching apparatus, according to the invention, comprises a controller adapted to control the operation of said apparatus, in particular of said first and second switching units.

According to the invention, the controller is configured to control said first and second switching units, so that said first and second switching units operate in combination according to the following operating configurations only:

- a first operating configuration, which corresponds to a closed state of said switching apparatus, in which both said first and second switching units are in a closed condition; or
- a second operating configuration, which corresponds to a stand-by state of said switching apparatus, in which said first switching unit is in an open condition and said second switching unit is in a closed condition; or a third operating configuration corresponding to an open state of said switching apparatus, in which both said first and second switching units are in an open condition.

Preferably, the above-mentioned controller is configured in such a way that, when said first and second switching units operate in combination according to said first operating configuration, said controller commands said first and second switching units to switch to said second operating configuration in response to receiving an input command indicative of a desired operating state for said switching apparatus.

Preferably, the above-mentioned controller is configured in such a way that, when said first and second switching units operate in combination according to said second operating configuration, said controller commands said first and second switching units to switch to said first operating configuration or to switch to said third operating configuration in response to receiving an input command indicative of a desired operating state for said switching apparatus.

Preferably, the above-mentioned controller is configured in such a way that, when said first and second switching units operate in combination according to said third operating configuration, said controller commands said first and second switching units to switch to said second operating configuration in response to receiving an input command indicative of a desired operating state for said switching apparatus.

Preferably, the above-mentioned controller is configured in such a way that, when said first and second switching units operate in combination according to said first operating configuration, said controller commands said first and second switching units to switch to said second operating configuration and subsequently to switch to said third operating configuration in response to receiving an input command indicative of a desired open state for said switching apparatus.

Preferably, the above-mentioned controller is configured in such a way that, when said first and second switching units operate in combination according to said third operating configuration, said controller commands said first and second switching units to switch to said second operating configuration and subsequently to switch to said first operating configuration in response to receiving an input command indicative of a desired closed state for said switching apparatus.

Preferably, the above-mentioned controller is configured in such a way that, when said first and second switching units operate in combination according to said first operating configuration, said controller commands said first and second switching units to switch to said second operating configuration in response to receiving an input command indicative of a desired stand-by state for said switching apparatus.

Preferably, the above-mentioned controller is configured in such a way that, when said first and second switching units operate in combination according to said second operating configuration, said controller commands said first and second switching units to switch to said first operating configuration in response to receiving an input command indicative of a desired closed state for said switching apparatus.

Preferably, the above-mentioned controller is configured in such a way that, when said first and second switching units operate in combination according to said third operating configuration, said controller commands said first and second switching units to switch to said second operating configuration in response to receiving an input command indicative of a desired stand-by state for said switching apparatus.

Preferably, the above-mentioned controller is configured in such a way that, when said first and second switching units operate in combination according to said second operating configuration, said controller commands said first and second switching units to switch to said third operating configuration in response to receiving an input command indicative of a desired open state for said switching apparatus.

According to an aspect of the invention, said controller comprises an interface section including one or more input ports adapted to receive the above-mentioned input commands indicative of a desired operating state for said switching apparatus.

Preferably, said switching apparatus comprises a human-machine interface in communication with said interface section. Said human-machine interface is adapted to provide the above-mentioned input commands upon an interaction with a user.

Preferably, said interface section is capable of communicating with a remote computerized device to receive the above-mentioned input commands.

According to an aspect of the invention, said controller is included in said first switching unit.

BRIEF DESCRIPTION OF THE FIGURES

Further characteristics and advantages of the present invention shall emerge more clearly from the description of preferred but not exclusive embodiments illustrated purely by way of examples and without limitation in the attached drawings, in which.

DETAILED DESCRIPTION

Figure 1:
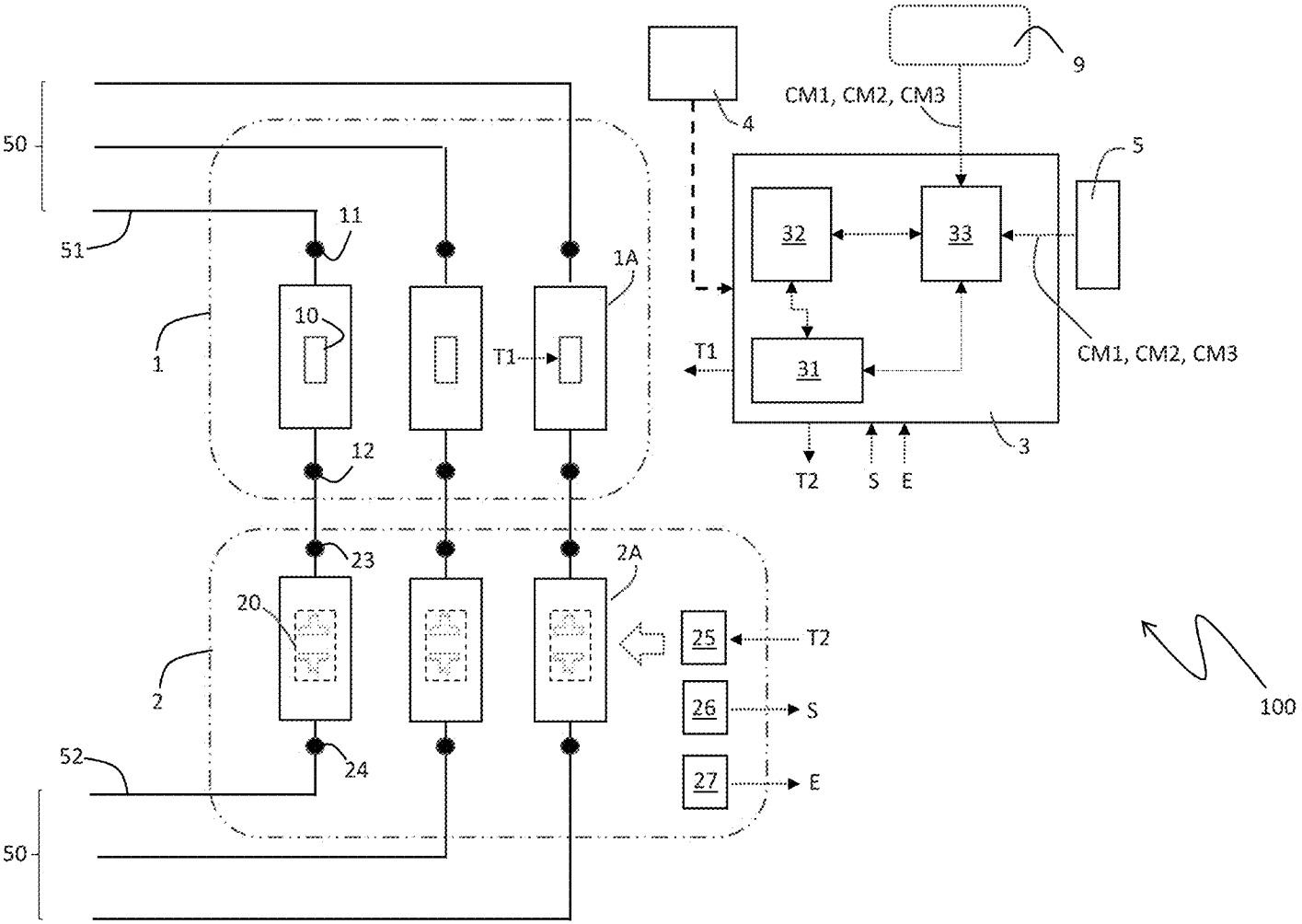
FIG. 1 schematically shows an embodiment of the switching apparatus, according to the invention.

With reference to the mentioned figures, the present invention relates to a switching apparatus 100 for electric power distribution grids, such as a circuit breaker, a disconnector, a contactor, or the like.

The switching apparatus 100 is particularly adapted for installation in low voltage electric grids or systems. However, it may be successfully used also in medium voltage electric grids or systems.

For the purposes of the present invention, the term "low voltage" (LV) relates to operating voltages lower than 1 kV AC and 1.5 kV DC while the term "medium voltage" (LV) relates to higher operating voltages up to some tens of kV, e.g. up to 72 kV AC and 100 kV DC.

The switching apparatus 100 comprises a first switching unit 1 of the SSCB type (hereinafter referred to also as "SSCB switching unit") and a second switching unit 2 of the electro-mechanical type (hereinafter referred to also as "electro-mechanical switching unit"), which are electrically connected in series.

The first switching unit 1 comprises one or more first electric poles 1A.

The number of electric poles of the first switching unit may vary, according to the needs. In the embodiment shown in the cited figures, the first switching unit 1 is of the three-phase type and it comprises three-electric poles. However, according to other embodiments of the invention (not shown), the first switching unit may include a different number of electric poles.

Each electric pole 1A is intended to be electrically connected with a corresponding first line conductor 51 of an electric line 500. The (one or more) first line conductors 51 of the electric line 500 may be connected to an equivalent electric power source, which may be, for example, an electric power feeding or generation system or a section of electric grid.

Preferably, for each electric pole 1A, the first switching unit 1 comprises a first pole contact 11 and a second pole contact 12.

Each first pole contact 11 is electrically connectable with a corresponding line conductor 51 of the electric line 500 while each second pole contact 12 is electrically connected in series with a pole contact 23 of a corresponding electric pole 2A of the switching unit 2.

Each electric pole 1A comprises one or more solid-state switches 10 adapted to operate in a conduction state or in an interdiction state to allow or interrupt a current flow along said electric pole.

Solid-state switches 10 may include, for example, MOSFETs, Insulated Gate Bipolar Transistors ("IGBTs"), Gate Turn-Off Thyristors (GTOs), Integrated Gate-Commutated Thyristors ("IGCTs"), or the like.

The solid-state switches 10 of each electric pole 1A are electrically connected with the pole contacts 11, 12 of this latter, for example according to a series circuit configuration or other more complex circuit configurations of known type.

In operation, the first switching unit 1 is capable of reversibly switching between a closed condition ON, in which the solid-state switches 10 of the electric poles 1A are in a conduction state, and an open condition OFF, in which the solid-state switches 10 of the electric poles 1A are in an interdiction state.

When the first switching unit is in a closed condition ON, line currents are allowed to flow through the electric poles 1A. Instead, when the first switching unit 1 is in an open condition OFF, no line currents can flow along the electric poles 1A. However, possible leakage currents, which typically affect solid-state switches in an interdiction state, may still circulate along the electric poles 1A.

A transition from a closed condition ON to an open condition OFF forms an opening manoeuvre of the first switching unit whereas a transition from an open condition OFF to a closed condition ON forms a closing manoeuvre of the first switching unit.

The first switching unit 1 may carry out an opening manoeuvre or a closing manoeuvre upon receiving first trip signals T1 from a controller 3.

Preferably, the first switching unit 1 includes one or more first driving circuits (not shown) adapted to receive the first trip signals T1 and drive the control terminals (e.g. gate terminals or base terminals) of the solid-state switches 10 depending on said first trip signals.

The second switching unit 2 comprises one or more second electric poles 2A.

Also the number of electric poles 2A of the second switching unit may vary, according to the needs. In general, the number of electric poles 2A corresponds to the number of the electric poles 1A of the FIRST switching unit.

Each electric pole 2A is electrically connected in series with a corresponding electric pole 1A of the first switching unit 1 and it is intended to be electrically connected with a corresponding second line conductor 52 of the electric line 500. The (one or more) second line conductors 52 of the electric line 500 may be connected to an equivalent electric load, which may be, for example, an electric system or apparatus or a section of electric grid.

Preferably, for each electric pole 2A, the second switching unit comprises a third pole contact 23 and a fourth pole contact 24.

Each third pole contact 23 is electrically connected in series with the second pole contact 12 of a corresponding electric pole 1A of the first switching unit while the fourth pole contact 24 electrically connectable with a corresponding second line conductor 52 of the electric line 500. Each second electric pole 2A comprises electric contacts 20 that can operate in a coupled state or on an uncoupled state to allow or interrupt a current flow along said second electric pole. Conveniently, the electrical contacts 20 of each electric pole 2A comprise a fixed electric contact and a movable electric contact (not shown). Each movable contact can be actuated to couple with or uncouple from the fixed contact.

In operation, the second switching unit 2 is capable of reversibly switching between a closed condition ON, in which the electric contacts 20 of the electric poles 2A are in a coupled state, and an open condition OFF, in which the electric contacts 20 of the electric poles 2A are in an uncoupled state.

When the second switching unit is in a closed condition ON, line currents are allowed to flow through the electric poles 2A. Instead, when the second switching unit is in an open condition OFF, no line currents can flow along the electric poles 2A.

A transition from a closed condition ON to an open condition OFF forms an opening manoeuvre of the second switching unit whereas a transition from an open condition OFF to a closed condition ON forms a closing manoeuvre of the second switching unit.

Preferably, the second switching unit 2 comprises one or more trip actuators 25 (which may be of known type) adapted to cause the actuation of the movable contacts of said switching unit in order to carry out the above-mentioned opening and closing manoeuvres.

As an example, the trip actuators 25 may include an opening coil actuator adapted to cause the actuation of the movable contacts of the electric poles 2A to carry out an opening manoeuvre and a closing coil actuator adapted to cause the actuation of the movable contacts of the electric poles 2A to carry out a closing manoeuvre.

The trip actuators 25 are operatively coupleable with a suitable actuation mechanism (not shown) adapted to actuate the movable contacts of the second switching unit. Such an actuation mechanism (which may be of known type) is conveniently designed to move the movable contacts of the second switching unit 2 upon tripping by the above-mentioned trip actuators.

The second switching unit 2 may carry out an opening manoeuvre or a closing manoeuvre upon receiving trip signals T2 from a controller.

Preferably, the second switching unit 2 may include one or more second driving circuits (not shown) adapted to receive the above-mentioned trip signals T2 and drive the trip actuators 25 depending on said second trip signals.

When driven according to the trip signals T2, the trip actuators 25 trip the above-mentioned actuation mechanism, which actuates the movable contacts of the second switching unit to carry out a closing manoeuvre or an opening manoeuvre of this latter.

Preferably, the second switching unit 2 comprises one or more sensing devices 26 adapted to provide sensing signals S indicative of the operating conditions of said second switching unit to a controller.

As an example, the sensing devices 26 may comprise a closing micro-switch (which may be of the known type) adapted to provide sensing signals indicative of a closed condition ON of the second switching unit and an opening a micro-switch (which may be of the known type) adapted to provide sensing signals indicative of an open condition OFF of the second switching unit.

Preferably, the second switching unit 2 comprises one or more enabling devices 27 adapted to provide enabling signals E to a controller in order to allow or prevent the second switching unit 2 to operate in a closed condition ON. As an example, the one or more enabling devices 27 may comprise a consent micro-switch (which may be of the known type) adapted to provide enabling signals E in order to enable the second switching unit 2 to operate in a closed condition ON.

According to some embodiments of the invention (not shown), the switching apparatus 100 is of the "withdrawable type".

In this case, the switching units 1, 2 are movable with respect to a fixed section of the switching apparatus. In particular, each switching unit is reversibly movable between an insertion position and a withdrawn position with respect to the fixed section of the switching apparatus. To this aim, each switching unit 1, 2 is preferably mounted on a respective carriage that is slidingly movable with respect to the fixed section of the switching apparatus.

As the switching units are movable, the first and fourth pole contacts 11, 24 of the switching apparatus are adapted to be electrically coupled with or uncoupled from corresponding line terminals (not shown), which are arranged in the fixed section of the switching apparatus and which are electrically connected with corresponding line conductors 51, 52 of the electric line. In general, the first and second switching units 1, 2 may be arranged at industrial level according to solutions of known type. Thus, hereinafter, they will be not described in further structural details, for the sake of brevity.

According to the invention, the switching apparatus 100 comprises a controller 3 adapted to control the operation of said switching apparatus, in particular of the first and second switching units 1, 2.

According to some embodiments of the invention (FIG. 1), the controller 3 is a self-standing device, which is not enclosed in anyone of the switching units 1, 2.

Figure 1A:
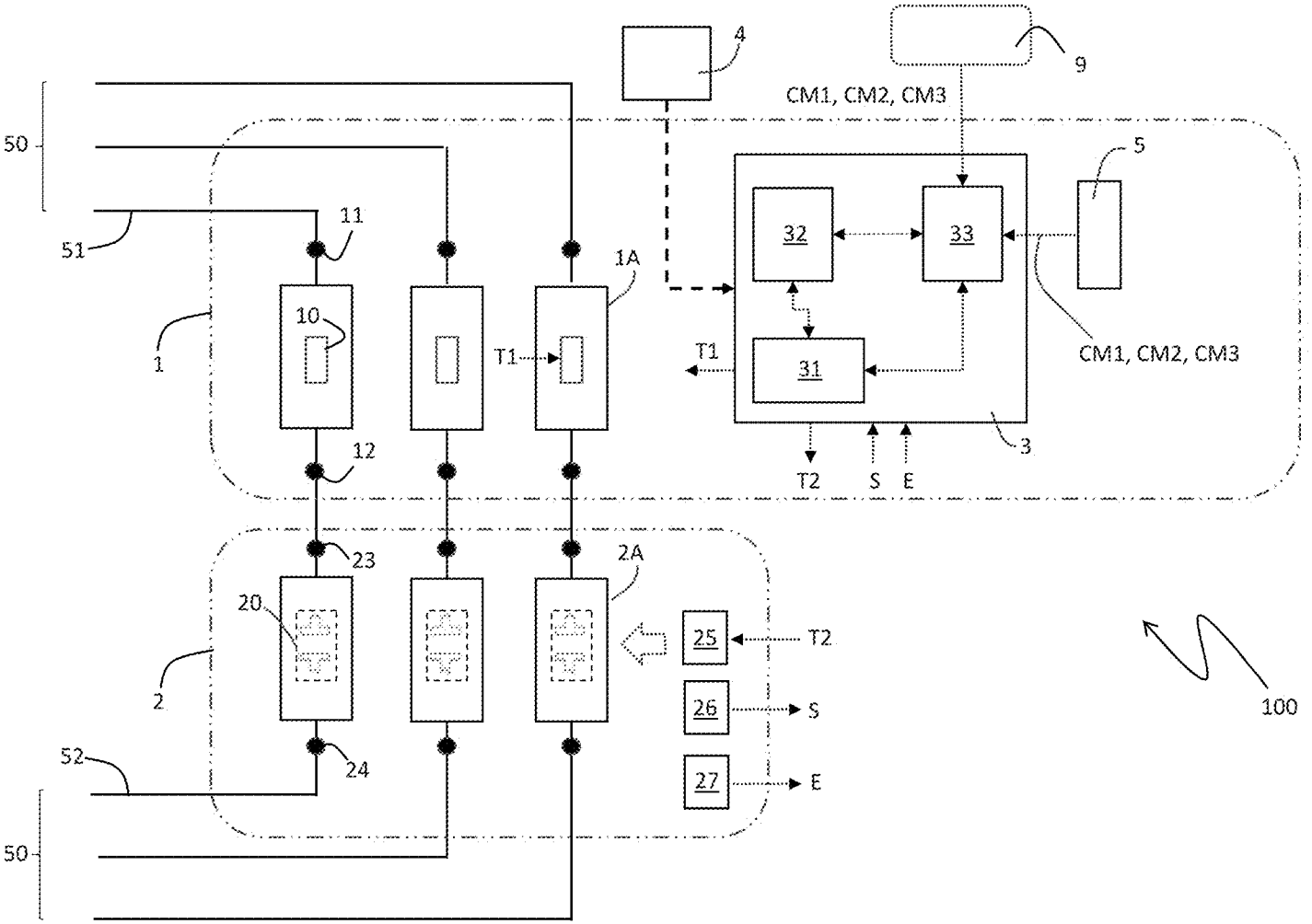
FIG. 1A schematically shows another embodiment of the switching apparatus, according to the invention.

According to other embodiments of the invention (FIG. 1A), the controller 3 is enclosed in one of the switching units 1 and 2, preferably in the first switching unit 1. In this case, the controller 3 may be the controller of the first switching unit, which is suitably configured to carry out also the functionalities described in the following (besides other functionalities specifically dedicated to the first switching unit).

Preferably, the controller 3 comprises a data processing section 31 adapted to process and provide data or control signals to implement the requested functionalities. In general, the data processing section 31 may include data processing resources of digital or analog type, e.g. one or more microprocessors or DSPs.

Preferably, the controller 3 comprises a trip section 32 adapted to interact with the data processing section 31 in order to generate the trip signals T1, T2 for controlling the operation of the switching units 1, 2. In general, the trip section 32 may include data processing resources of digital or analog type, e.g. one or more microprocessors or DSPs.

Preferably, the controller 3 is adapted to receive and process input commands CM1, CM2, CM3 (e.g. formed by suitable control signals) indicative of a desired operating state for the switching apparatus 100 in order to control the operation of the switching units 1, 2.

Preferably, the controller 3 comprises an interface section 33 including one or more input ports adapted to receive the input commands CM1, CM2, CM3.

Preferably, the switching apparatus 100 comprises a human-machine interface 5 in communication with the interface section 33 of the controller 3. The human-machine interface 5 is adapted to provide the input commands CM1, CM2, CM3 upon an interaction with a user.

As an example, the human-machine interface 5 may include suitable buttons that a user can press to generate the input commands CM1, CM2, CM3.

As another example, the human-machine interface 5 may include a touch-screen including suitable graphic resources (e.g. digital buttons) that a user can activate to generate the input commands CM1, CM2, CM3.

As an additional example, the human-machine interface 5 may interact (e.g. in a wireless manner) with a computer device of a user to generate the input commands CM1, CM2, CM3. Preferably, the human-machine interface 5 is a self-standing device, which is not enclosed in anyone of the switching units 1, 2.

According to other embodiments of the invention (FIG. 1A), the human-machine interface 5 is enclosed in one of the switching units, preferably in the first switching unit 1. In this case, the human-machine interface 5 may be the human-machine interface of the first switching unit, which is suitably configured to carry out the above-mentioned functionalities (besides other functionalities specifically dedicated to the first switching unit).

According to some embodiments of the invention, the interface section 33 of the controller 3 is adapted to communicate with a remote computerized device 9 (which in general is not part of the switching apparatus 100), e.g. a digital relay. Conveniently, the interface 33 may receive the input commands CM1, CM2, CM3 from the computerized device 9.

Preferably, the switching apparatus 100 comprises an auxiliary power supply 4 adapted to provide a suitable feeding voltage to the controller 3 and other possible electric or electronic components of the switching apparatus, e.g. the above-mentioned driving circuits included in the switching units. In general, the auxiliary power supply 4 may include any power and control circuit of digital or analog type, according to the needs.

Preferably, the auxiliary power supply 4 is a self-standing device. However, arrangements of different type are available to the skilled person.

In general, the controller 3, the human-machine interface 5 and the auxiliary power supply 4 may be arranged at industrial level according to hardware solutions of known type. Thus, hereinafter, they will be not described in further structural or circuit details, for the sake of brevity.

An important aspect of the invention consists in that the controller 3 implements a special control logic to control the operation of the switching apparatus 100 by controlling the operation of the first and second switching units 1, 2.

Figure 2:
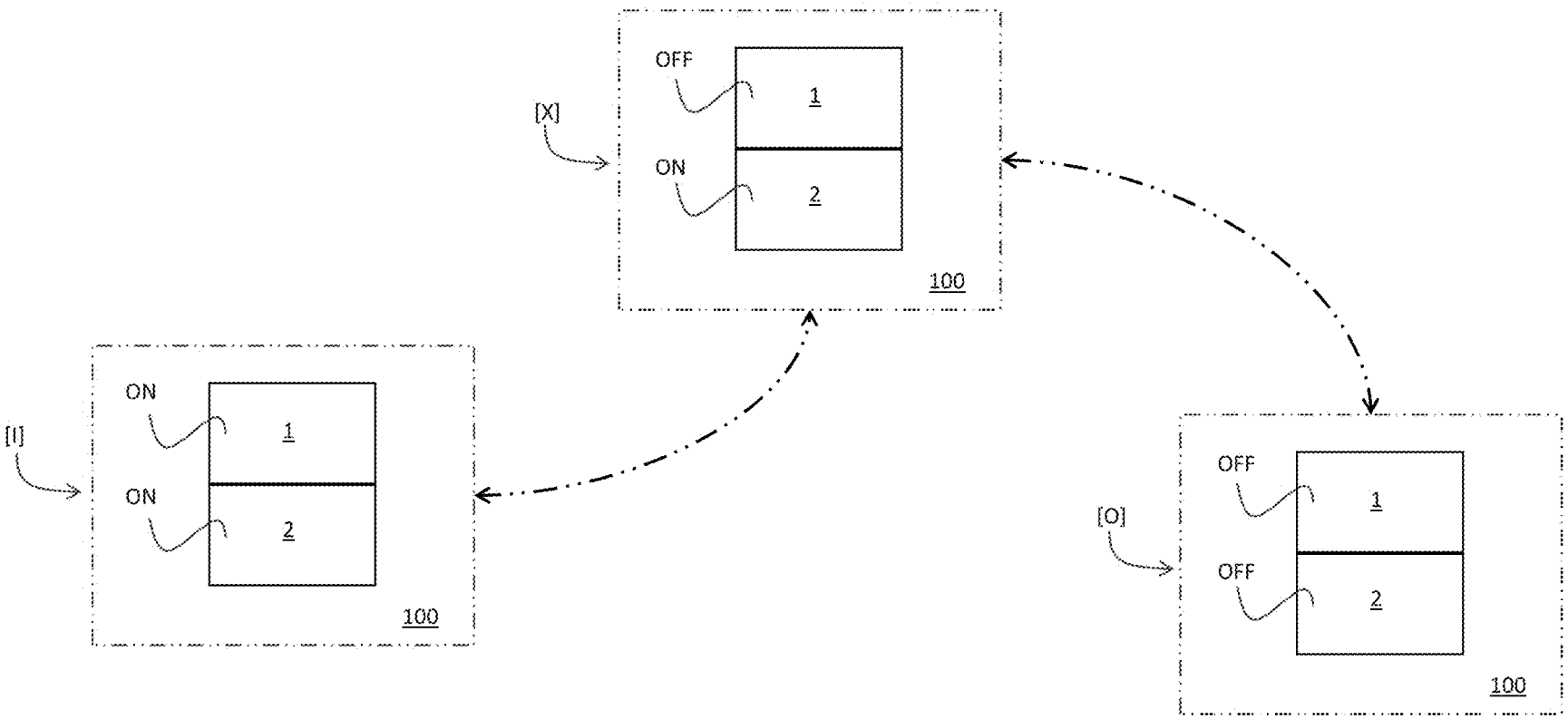
FIGS. 2-8 schematically show the operation of a controller included the switching apparatus, according to the invention.

According to such a control logic, the first and second switching units 1, 2 may take in combination only specific operating configurations, each configuration corresponding to a predefined given operating state of the switching apparatus 100 (FIG. 2).

More particularly, according to the invention, the controller 3 controls the first and second switching units 1, 2 in such a way that these latter can operate in combination, according to the following operating configurations only:

- a first operating configuration [I], in which both the first and second switching units 1, 2 are in a closed condition ON; or
- a second operating configuration [X], in which the first switching unit 1 is in an open condition OFF and the second switching unit 2 is in a closed condition ON; or
- a third operating configuration [O], in which both the first and second switching units 1, 2 are in an open condition OFF.

When the first and second switching units 1, 2 operate in combination according to the first operating configuration [I], line currents are allowed to flow through the electric poles 1A, 2A of the switching units 1, 2. Thus, it is ensured the electrical continuity between the conductors 51, 52 of the electric line 500. The first operating configuration [I] of the first and second switching units corresponds to a closed state of the switching apparatus.

When the first and second switching units 1, 2 operate in combination according to the second operating configuration [X], line currents are not allowed to flow along the electric poles 1A, 2A of the switching units as the first switching unit 1 is in an open condition OFF. The line conductors 51, 52 of the electric line 500 are thus disconnected. However, there is no galvanic insulation between them as the second switching unit 2 is in a closed condition ON and possible leakage currents affecting the solid-state switches 10 of the first switching unit 1 can still flow along the electric poles 1A, 2A. The second operating configuration [X] of the first and second switching units corresponds to a stand-by state of the switching apparatus, which is intermediate between a closed state and an open state.

When the first and second switching units 1, 2 operate in combination according to the third operating configuration [O], line currents and possible leakage currents are not allowed to flow along the electric poles 1A, 2A of the switching units as the both these latter are in an open condition OFF. The line conductors 51, 52 of the electric line 500 are disconnected and a galvanic insulation between them is ensured. The third operating configuration [O] of the first and second switching units corresponds to an open state of the switching apparatus 100.

Preferably, the controller 3 is configured to command the first and second switching units 1, 2 to switch from one operating configuration to another in response to receiving the above-mentioned input commands CM1, CM2, CM3 indicative of a desired operating state for the switching apparatus 100.

However, according the control logic implemented by the controller 3, any transition between the operating configurations of the first and second switching units 1, 2 has always to involve the second operating configuration [X], which corresponds to a stand-by state of the switching apparatus 100 (FIG. 2).

In other words, the controller 3 is configured to control the switching units 1, 2 in such a way to prevent any direct transition between the first operating configuration [I] and the third configuration [O] of the switching units 1, 2.

Preferably, when the first and second switching units 1, 2 are in the first operating configuration [I] (corresponding to a closed state of the switching apparatus 100), in response to receiving an input command CM2, CM3 indicative of a desired operating state for the switching apparatus 100, the controller 3 commands the first and second switching units 1, 2 to switch to the second operating configuration [X] (corresponding to a stand-by state of the switching apparatus 100). In practice, according to the control logic implemented by the controller 3, the first and second switching units 1, 2 can switch from the first operating configuration [I] to another operating configuration only passing through the second operating configuration [X].

This implies that, when it is in a closed state (first operating configuration [I] of the switching units 1, 2), in response to receiving an input command CM2, CM3 indicative of a desired different operating state, the switching apparatus 100 can switch to another operating state only passing through the stand-by state (second operating configuration [X] of the switching units 1, 2).

Preferably, when the first and second switching units 1, 2 are in the second operating configuration [X] (corresponding to a stand-by state of the switching apparatus 100), in response to receiving an input command CM1, CM3 indicative of a desired operating state for the switching apparatus 100, the controller 3 commands the first and second switching units 1, 2 to switch to the first operating configuration [I] (corresponding to a closed state of the switching apparatus 100) or to switch to the third operating configuration [O] (corresponding to an open state of the switching apparatus 100).

In practice, according to the control logic implemented by the controller 3, the first and second switching units 1, 2 can switch from the second operating configuration [X] either to the first operating configuration [I] or to the third operating configuration [O] depending on the received input command CM1, CM3.

This implies that, when it is in a stand-by state (second operating configuration [X] of the switching units 1, 2), in response to receiving an input command CM1, CM3 indicative of a desired different operating state, the switching apparatus 100 can switch either to a closed state (first operating configuration [I] of the first and second switching units 1, 2) or to an open state (third operating configuration [O] of the first and second switching units 1, 2) depending on the received input command CM1, CM3.

Preferably, when the first and second switching units 1, 2 are in the third operating configuration [O] (corresponding to an open state of the switching apparatus 100), in response to receiving an input command CM1, CM2 indicative of a desired operating state for the switching apparatus 100, the controller 3 commands the first and second switching units 1, 2 to switch to the second operating configuration [X] (corresponding to a stand-by state of the switching apparatus 100). In practice, according to the control logic implemented by the controller 3, the first and second switching units 1, 2 can switch from the third operating configuration [O] to another operating configuration only passing through the second operating configuration [X].

This implies that, when it is in an open state (third operating configuration [O] of the switching units 1, 2), in response to receiving an input command CM1, CM2 indicative of a desired different operating state, the switching apparatus 100 can switch to another operating state only passing through the stand-by state (second operating configuration [X] of the switching unit 1, 2).

Figure 3:
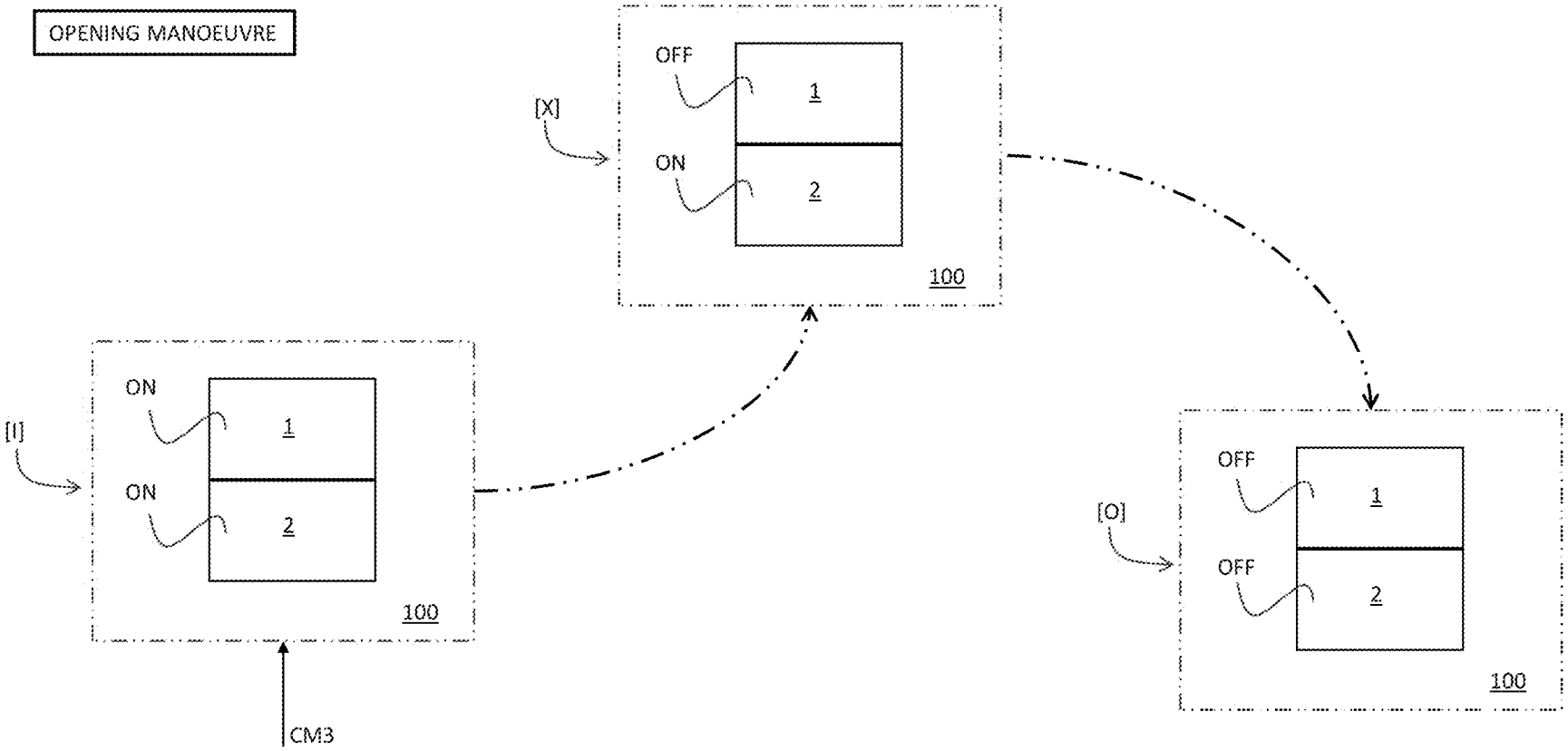

FIG. 3 shows the operation of the controller 3, when the switching apparatus 100 has to carry out an opening manoeuvre, i.e. a transition from a closed state to an open state, in response to receiving an input command CM3 indicative of a desired open state for the switching apparatus 100 (opening input command).

In this case, the controller 3 has to manage a transition from the first operating configuration [I] to the third operating configuration [O] of the first and second switching units 1, 2.

Preferably, when the first and second switching units 1, 2 are in the first operating configuration [I] (corresponding to a closed state of the switching apparatus 100), in response to receiving an opening input command CM3, the controller 3 commands the first and second switching units 1, 2 to switch to the second operating configuration [X] (corresponding to a stand-by state of the switching apparatus 100) and subsequently to switch to the third operating configuration [O] (corresponding to an open state of the switching apparatus 100).

In practice, the controller 3 is configured to control the switching units 1, 2 in such a way that these latter have always to take the second operating configuration [X], during an opening manoeuvre of the switching apparatus 100. This implies that the switching apparatus 100 has always to pass through a stand-by state when it carries out an opening manoeuvre in response to receiving the opening input command CM3.

Figure 4:
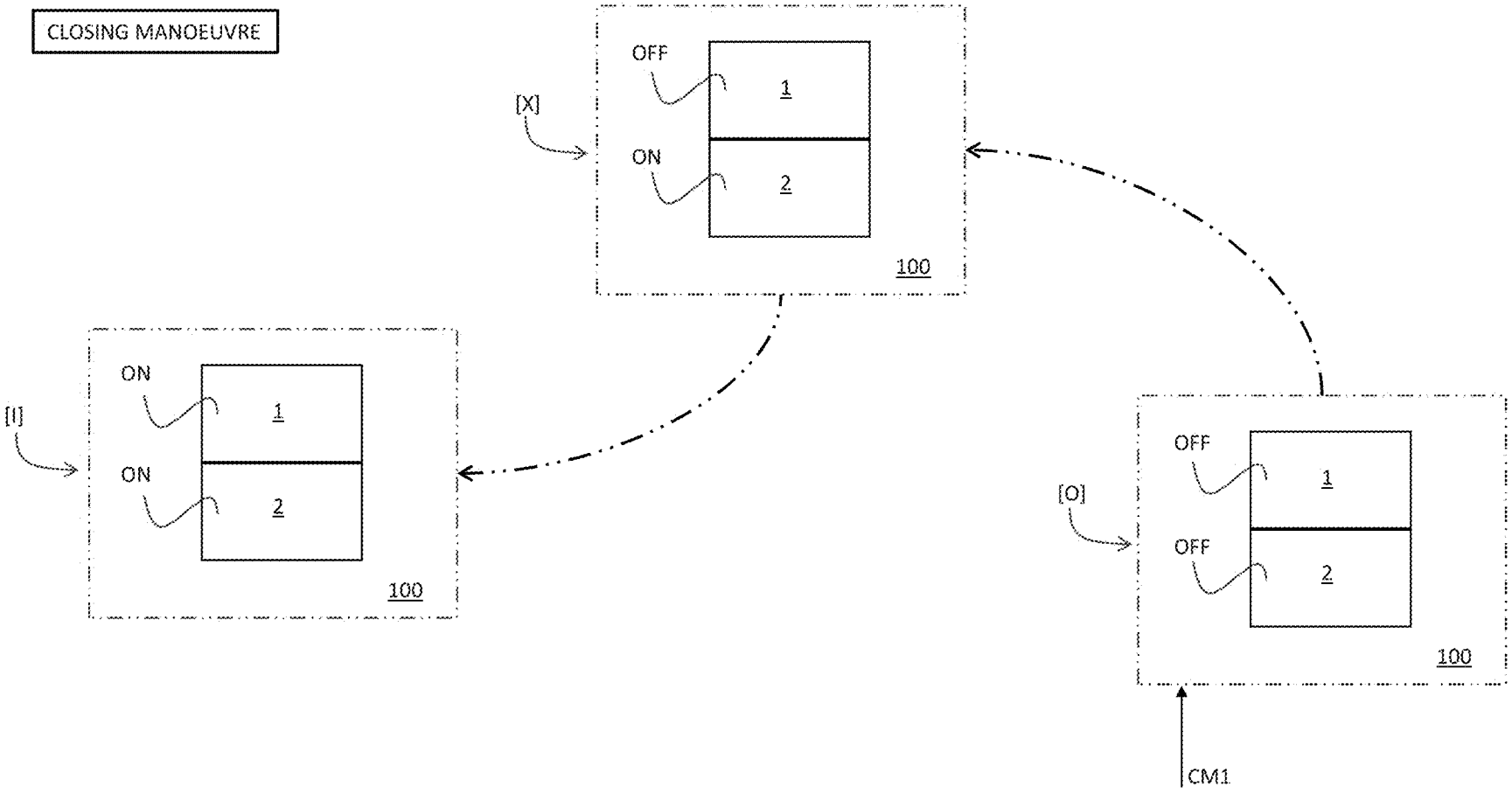

FIG. 4 shows the operation of the controller 3, when the switching apparatus 100 has to carry out a closing manoeuvre, i.e. a transition from an open state to a closed state, in response to receiving an input command CM1 indicative of a desired closed state for the switching apparatus 100 (closing input command).

In this case, the controller 3 has to manage a transition from the third operating configuration [O] to the first operating configuration [I] of the first and second switching units 1, 2.

Preferably, when the first and second switching units 1, 2 are in the third operating configuration [O] (corresponding to an open state of the switching apparatus 100), in response to receiving a closing input command CM1, the controller 3 commands the first and second switching units 1, 2 to switch to the second operating configuration [X] (corresponding to a stand-by state of the switching apparatus 100) and subsequently to switch to the first operating configuration [I] (corresponding to a closed state of the switching apparatus 100).

In practice, the controller 3 is configured to control the switching units 1, 2 in such a way that these latter have always to take the second operating configuration [X], during a closing manoeuvre of the switching apparatus 100. This implies that the switching apparatus 100 has always to pass through a stand-by state when it carries out a closing manoeuvre in response to receiving the closing input command CM1.

Figure 5:
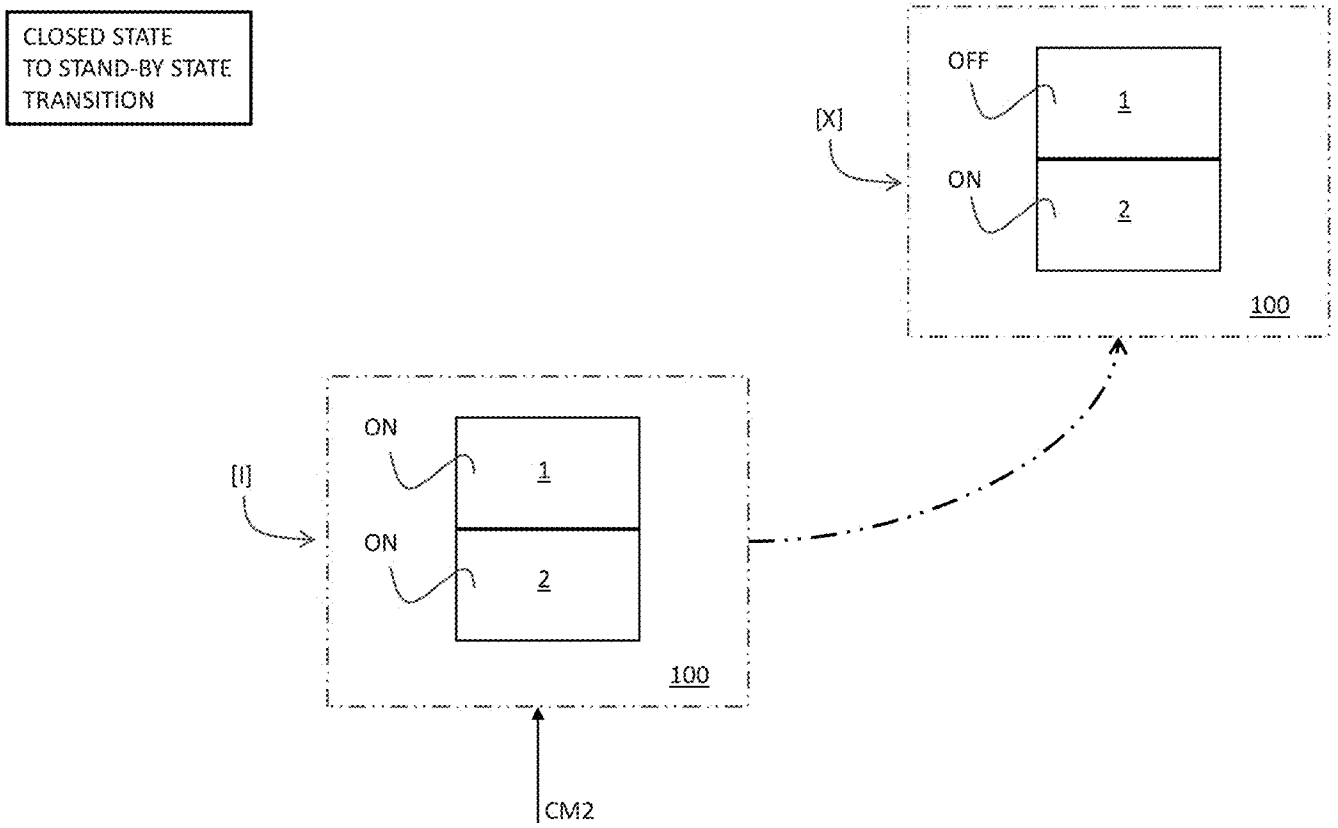

FIG. 5 shows the operation of the controller 3, when the switching apparatus 100 has to carry out a transition from a closed state to a stand-by state, in response to receiving an input command CM2 indicative of a desired stand-by state for the switching apparatus 100 (stand-by input command).

Preferably, when the first and second switching units 1, 2 are in the first operating configuration [I] (corresponding to a closed state of the switching apparatus 100), in response to receiving a stand-by input command CM2, the controller 3 commands the first and second switching units 1, 2 to switch to the second operating configuration [X] (corresponding to a stand-by state of the switching apparatus 100).

Figure 6:
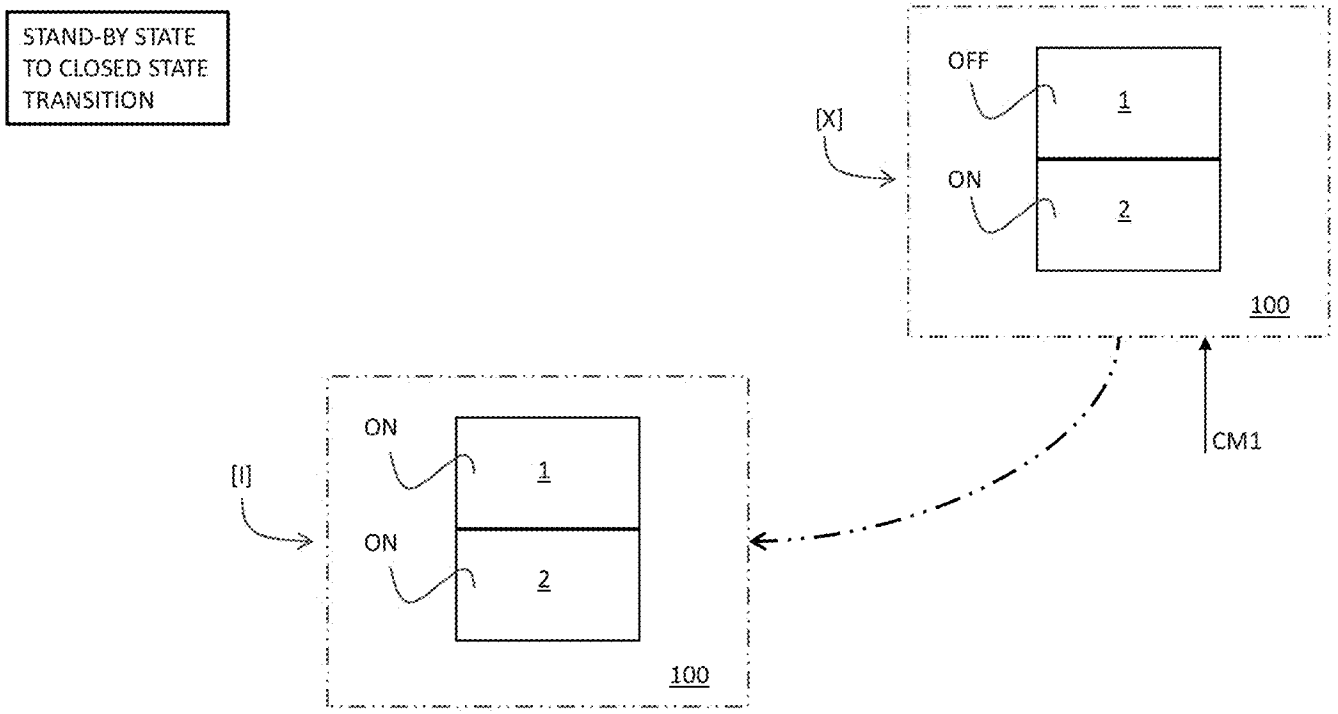

In practice, the controller 3 is configured to control the switching units 1, 2 in such a way that these latter can directly switch from the first operating configuration [I] to the second operating configuration [X]. This implies that the switching apparatus 100 can always pass directly from a closed state to a stand-by state in response to receiving the stand-by input command CM2. FIG. 6 shows the operation of the controller 3, when the switching apparatus 100 has to carry out a transition from a stand-by state to a closed state, in response to receiving a closing input command CM1.

Preferably, when the first and second switching units 1, 2 are in the second operating configuration [X] (corresponding to a stand-by state of the switching apparatus 100), in response to receiving the closing input command CM1, the controller 3 commands the first and second switching units 1, 2 to switch to the first operating configuration [I] (corresponding to a closed state of the switching apparatus 100).

Figure 7:
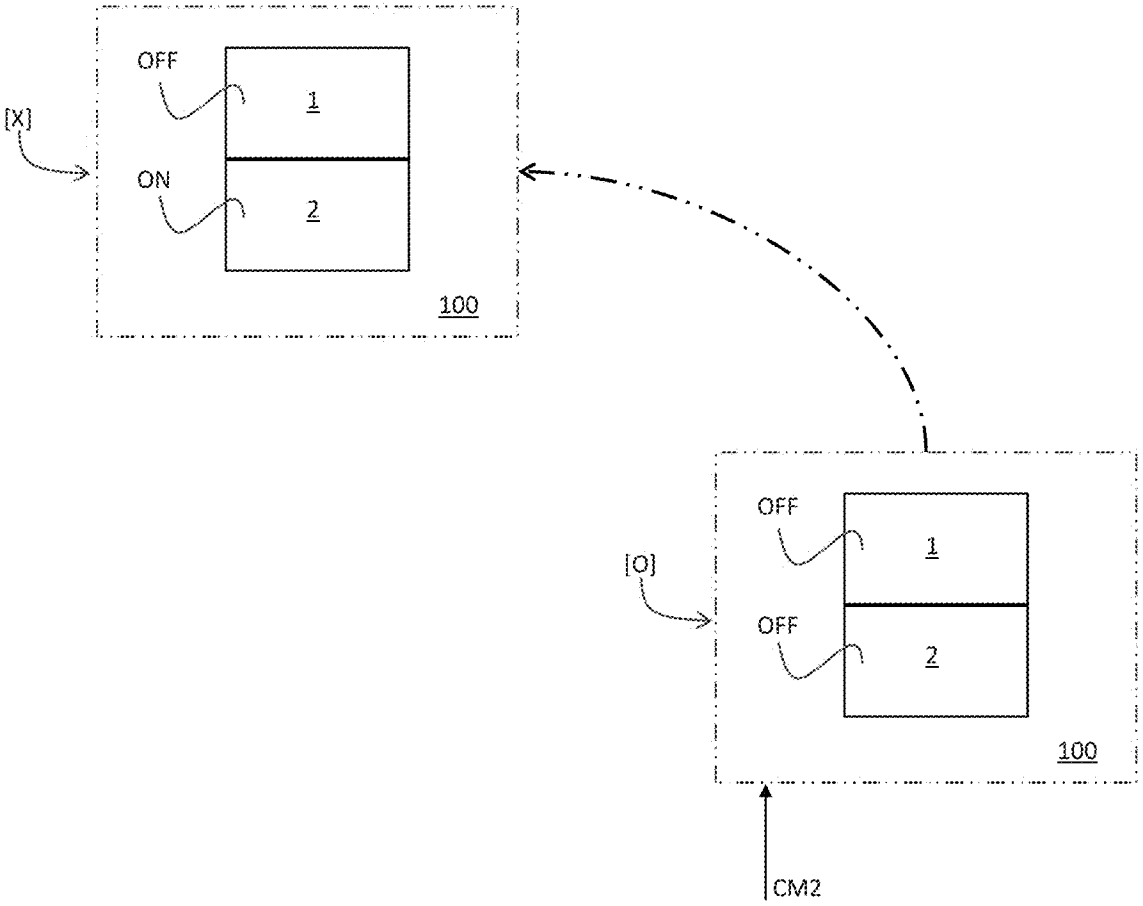

In practice, the controller 3 is configured to control the switching units 1, 2 in such a way that these latter can directly switch from the second operating configuration [X] to the first operating configuration [I]. This implies that the switching apparatus 100 can always pass directly from a stand-by state to a closed state in response to receiving the closing input command CM1. FIG. 7 shows the operation of the controller 3, when the switching apparatus 100 has to carry out a transition from an open state to a stand-by state, in response to receiving a stand-by input command CM2.

Preferably, when the first and second switching units 1, 2 are in the third operating configuration [O] (corresponding to an open state of the switching apparatus 100), in response to receiving the stand-by input command CM2, the controller 3 commands the first and second switching units 1, 2 to switch to the second operating configuration [X] (corresponding to a stand-by state of the switching apparatus 100).

Figure 8:
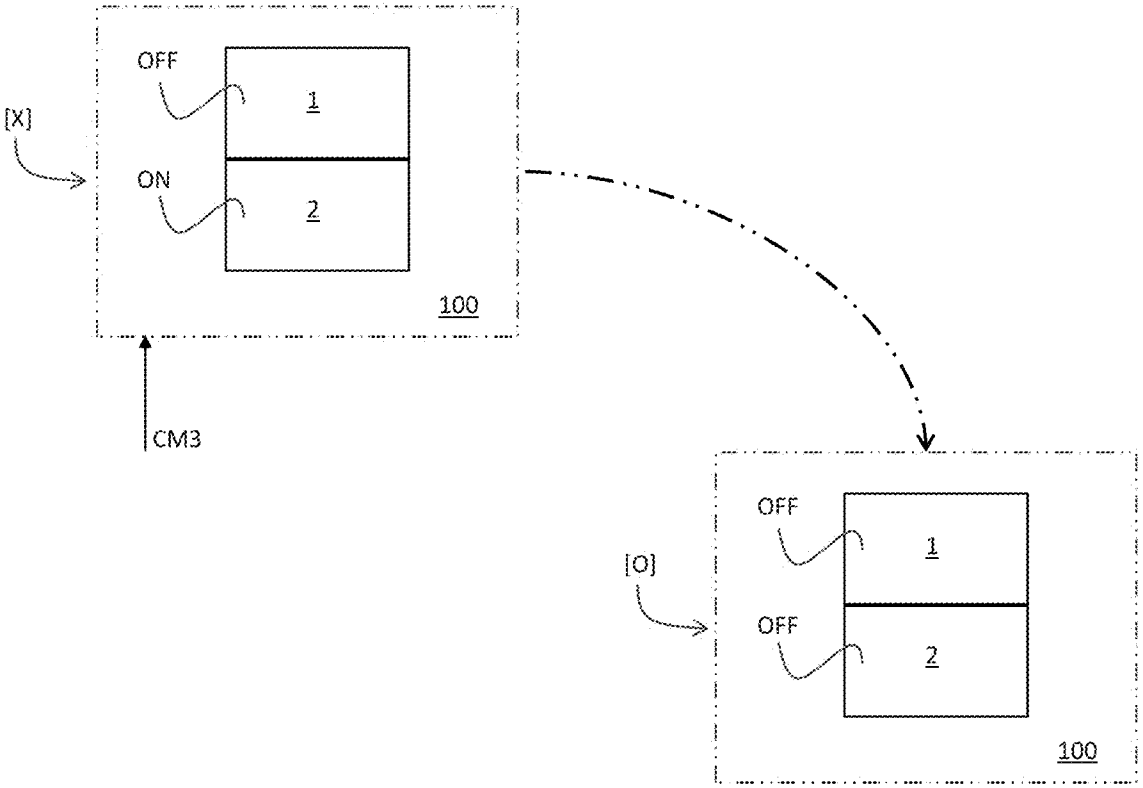

In practice, the controller 3 is configured to control the switching units 1, 2 in such a way that these latter can directly switch from the third operating configuration [O] to the second operating configuration [X]. This implies that the switching apparatus 100 can always pass directly from an open state to a stand-by state in response to receiving the stand-by input command CM2. FIG. 8 shows the operation of the controller 3, when the switching apparatus 100 has to carry out a transition from a stand-by state to an open state, in response to receiving an opening input command CM3.

Preferably, when the first and second switching units 1, 2 are in the second operating configuration [X] (corresponding to a stand-by state of the switching apparatus 100), in response to receiving the opening input command CM3, the controller 3 commands the first and second switching units 1, 2 to switch to the third operating configuration [O] (corresponding to an open state of the switching apparatus 100).

In practice, the controller 3 is configured to control the switching units 1, 2 in such a way that these latter can directly switch from the second operating configuration [X] to the third operating configuration [O]. This implies that the switching apparatus 100 can always pass directly from a stand-by state to an open state in response to receiving the opening input command CM3.

The switching apparatus 100 of the invention provides relevant advantages with respect to available corresponding solutions of the state of the art.

Differently from the known solutions of the state of the art, the controller 3 of the switching apparatus 100 is configured to control the first and second switching units 1, 2 in such a way that the switching apparatus 100 can take a stand-by state (second configuration [X] of the first and second switching units 1, 2) in addition to a closing state (first configuration [I] of the first and second switching units 1, 2) and an open state (third configuration [O] of the first and second switching units 1, 2).

Such a solution allows relaxing the time synchronization constraints between the switching operations of the switching units 1, 2 when the switching apparatus 100 has to carry out an opening manoeuvre (i.e. a transition from a closed state to an open state) or a closing manoeuvre (i.e. a transition from an open state to a closed state).

The switching apparatus 100 can thus operate according to a robust control logic, which does not need complex and expensive control resources for its implementation.

The switching apparatus 100 therefore ensures high levels of efficiency and reliability in operation.

At the same time, the switching apparatus 100 can be manufactured at industrial level at competitive costs with respect to similar installations of the state of the art.

The invention claimed is:

1. A switching apparatus for electric power distribution grids comprising:

a first switching unit having one or more first electric poles, each first electric pole being electrically connectable with a corresponding first line conductor of an electric line and comprising one or more solid-state switches adapted to operate in a conduction state or in an interdiction state to allow or interrupt a current flow, wherein said first switching unit is adapted to switch reversibly between a closed condition, in which said solid-state switches are in the conduction state, and an open condition, in which said solid-state switches are in the interdiction state;

a second switching unit having one or more second electric poles, each second electric pole being electrically connectable with a corresponding second line conductor of said electric line and electrically connected in series with a corresponding first electric pole of said first switching unit, each second electric pole comprising electric contacts adapted to operate in a coupled state or on an uncoupled state to allow or interrupt a current flow along said second electric pole, wherein said second switching unit is adapted to switch reversibly between a closed condition, in which said electric contacts are in the coupled state, and an open condition, in which said electric contacts are in the uncoupled state; and a controller configured to control said first and second switching units, so that said first and second switching units operate in combination according to the following operating configurations:

a first operating configuration corresponding to a closed state of said switching apparatus, in which both said first and second switching units are in a closed condition; or a second operating configuration corresponding to a stand-by state of said switching apparatus, in which said first switching unit is in an open condition and said second switching unit is in a closed condition; or a third operating configuration corresponding to an open state of said switching apparatus, in which both said first and second switching units are in an open condition, wherein said first and second switching units operate in combination according to said first operating configuration or said third operating configuration, and wherein said controller commands said first and second switching units to switch to said second configuration in response to receiving an input command indicative of a desired stand-by state for said switching apparatus.

2. The switching apparatus, according to claim 1, wherein when said first and second switching units initially operate in combination according to said first operating configuration, said controller commands said first and second switching units to switch to said second operating configuration in response to receiving an input command indicative of a desired operating state for said switching apparatus.

3. The switching apparatus, according to claim 1, wherein when said first and second switching units subsequently operate in combination according to said second operating configuration, said controller commands said first and second switching units to switch to said first operating configuration or to switch to said third operating configuration in response to receiving an input command indicative of a desired operating state for said switching apparatus.

4. The switching apparatus, according to claim 3, wherein when said first and second switching units operate in combination according to said second operating configuration, said controller commands said first and second switching units to switch to said first operating configuration in response to receiving an input command indicative of a desired closed state for said switching apparatus.

5. The switching apparatus, according to claim 3, wherein when said first and second switching units operate in combination according to said second operating configuration, said controller commands said first and second switching units to switch to said third operating configuration in response to receiving an input command indicative of a desired open state for said switching apparatus.

6. The switching apparatus, according to claim 1, wherein when said first and second switching units initially operate in combination according to said third operating configuration, said controller commands said first and second switching units to switch to said second operating configuration in response to receiving an input command indicative of a desired operating state for said switching apparatus.

7. The switching apparatus, according to claim 1, wherein when said first and second switching units initially operate in combination according to said first operating configuration, said controller commands said first and second switching units to switch to said second operating configuration and subsequently to switch to said third operating configuration in response to receiving an input command indicative of a desired open state for said switching apparatus.

8. The switching apparatus, according to claim 1, wherein when said first and second switching units initially operate in combination according to said third operating configuration, said controller commands said first and second switching units to switch to said second operating configuration and subsequently to switch to said first operating configuration in response to receiving an input command indicative of a desired closed state for said switching apparatus.

9. The switching apparatus, according to claim 1, wherein said controller comprises an interface section including one or more input ports adapted to receive input commands indicative of a desired operating state for said switching apparatus.

10. The switching apparatus, according to claim 9, comprising a human-machine interface in communication with said interface section, said human-machine interface being adapted to provide said input commands upon an interaction with a user.

11. The switching apparatus, according to claim 9 wherein said interface section is capable of communicating with a remote computerized device to receive said input commands.

12. The switching apparatus, according to claim 1, wherein said controller is included in said first switching unit.

13. The switching apparatus, according to claim 1, wherein it is of a withdrawable type.

* * * * *